United States Patent [19]

Ngo

[11] 3,979,638

[45] Sept. 7, 1976

[54] PLASMA PANEL WITH DYNAMIC KEEP-ALIVE OPERATION

[75] Inventor: Peter Dinh-Tuan Ngo, Colts Neck, N.J.

[73] Assignee: Bell Telephone Laboratories, Incorporated, Murray Hill, N.J.

[22] Filed: Apr. 15, 1974

[21] Appl. No.: 460,757

[52] U.S. Cl. ..... 315/169 TV; 315/169 R; 340/324 M

[51] Int. Cl.[2] ..... H05B 37/00

[58] Field of Search ..... 315/169 TV, 171, 169 R; 340/324 M

[56] References Cited

UNITED STATES PATENTS

| | | | |
|---|---|---|---|
| 3,654,507 | 4/1972 | Caras et al. | 315/169 TV X |
| 3,733,435 | 5/1973 | Chodil et al. | 315/169 TV X |
| 3,742,483 | 6/1973 | Ogle | 315/169 TV X |

*Primary Examiner*—R. V. Rolinec
*Assistant Examiner*—Lawrence J. Dahl
*Attorney, Agent, or Firm*—William Ryan; Ronald D. Slusky

[57] ABSTRACT

An a-c plasma display panel including apparatus for driving the keep-alive cell sustain signal circuits in a non-fixed relation with address pulses. By constraining the keep-alive cells to be sustained in a time relation dependent on the address of a cell being addressed it is possible to increase the margins for the address signals and, in general, permit a reduction in magnitude of such address signals.

20 Claims, 18 Drawing Figures

FIG. 11
| 3msb | 3msb INVERTED | τ | |
|---|---|---|---|
| 000 | | τ=3ΔT | FIRST HALF |
| 001 | | τ=2ΔT | |
| 010 | | τ=ΔT | |
| 011 | | τ=0 | |
| 100 | 011 | τ=0 | SECOND HALF |
| 101 | 010 | τ=ΔT | |
| 110 | 001 | τ=2ΔT | |
| 111 | 000 | τ=3ΔT | |
0 X
FIG. 12
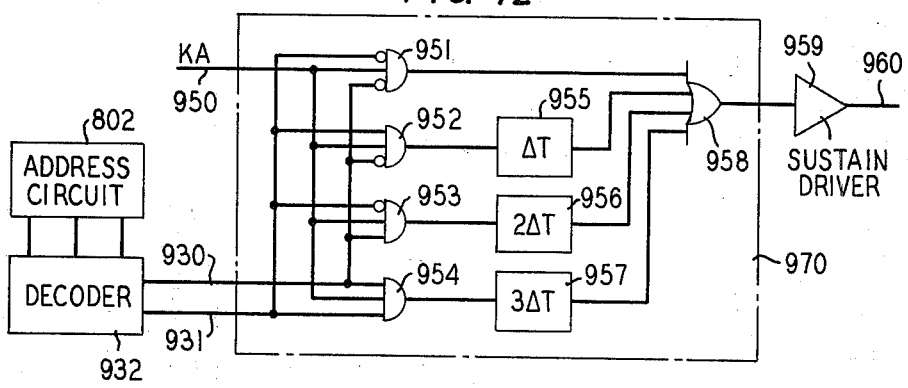
FIG. 13
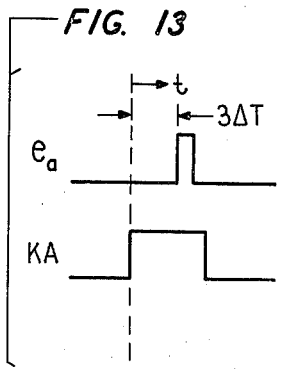

PLASMA PANEL WITH DYNAMIC KEEP-ALIVE OPERATION

BACKGROUND OF THE INVENTION

1. Field of the Invention

The present invention relates to plasma display panels. More particularly, the present invention relates to plasma display panels of the matrix variety containing a plurality of individual display cells defined by the intersection of substantially orthogonal sets of conductors. Still more particularly, the present invention relates to such matrix plasma panels employing so-called "keep-alive" cells disposed around the periphery of the matrix proper for purposes of facilitating the breakdown of the gas at an addressed cell by increasing the density of photons, photo electrons and ions at that cell.

2. Description of the Prior Art

In U.S. Pat. No. 3,559,190 issued Jan. 26, 1971, to D. L. Bitzer et al, there is disclosed a gaseous display and memory system which may be characterized as being of the pulsing discharge type having a gaseous medium, usually a mixture of two gases at a relatively high pressure, in a thin gas chamber or space between opposed dielectric charge storage members which are backed by conductor arrays. The conductor arrays backing each dielectric member are typically arranged in overlapping orthogonal manner to define a plurality of discrete discharge volumes or cells. The discharge units in the Bitzer et al. system are additionally defined by a perforated plate interposed between the two dielectric members with the perforations being aligned at points where the overlapping of the conductor arrays occur. In U.S. Pat. No, 3,499,167 issued Mar. 3, 1970 to Baker et al., a similar system is disclosed. Because of other system parameters, it is possible to eliminate in the Baker et al. system the physical barriers provided by the perforated member.

In any event, in plasma panels of this general type operation is based on the fact that a conducting plasma of electrons and positive ions is produced upon ionization of the gas contained in the envelope of the panel. This occurs upon selection of a particular cell by applying appropriate operating potentials to a particular pair of crossed conductors, one from each of the orthogonally arranged arrays. When a cell is once selected by standard half select techniques and a gas discharge is effected at a particular selected cell, it is possible to maintain in future cycles the discharge at that cell with a somewhat lower operating voltage. Thus, though a particularly high voltage is necessary to write such a cell, it proves possible to sustain a discharge at subsequent times by repetitively applying an AC (sinosoidal or pulse) sustain signal having a magnitude lower than the write signal.

A description of typical commercially available AC plasma display system, is contained in Johnson and Schmersal, "A Quarter-Million-Element AC Plasma Display with Memory," *Proc. of the S.I.D.*, Vol. 13, No. 1, First Quarter 1972, pp. 56–60. The panel described in the Johnson and Schmersal paper is manufactured by Owens-Illinois, Inc.

It is well known in the art that to facilitate the operation of cells disposed in a matrix fashion on a substantially planar panel, e.g., of the type described in the Johnson and Schmersal paper, the working atmosphere surrounding each cell is advantageously "enriched" by the presence of free ions, electrons or photons. It has proven advantageous in prior art systems to provide an initial source of such ions or photons integral with the panel itself, or to apply photons from an external source, e.g., from an ultraviolet light source. In providing a source of ions or photons by virtue of structure integral with the matrix display proper, it has proven useful to provide so-called keep-alive cells which have as their purpose to create the required ions or photons. Such keep-alive cells are described, for example, in U.S. Pat. No. 3,654,507 issued Apr. 4, 1972 to Caras and Ogle; and in Holz, "The Primed Gas Discharge Cell—A Cost and Capability Improvement for Gas Discharge Matrix Displays," *Proc. of the S.I.D.*, Vol. 13, No. 1, First Quarter 1972, pp. 2–5.

The above-cited panel described in the Johnson and Schmersal paper advantageously utilizes such keep-alive cells as well. However, the panel described and manufactured by Owens-Illinois utilizes keep-alive cells positioned around the entire panel. In typical configuration, then, the band of cells, including four rows or columns of cells around the borders of the Owens-Illinois panel, are maintained in the "on" state to create the required radiation (photons or photo electrons, etc.). These border keep-alive cells are driven from a separate sustain source which is adjusted to be fixedly synchronized with the application of the write and other address signals.

It has been the experience of plasma panel designers, especially those desiring to build a panel of any substantial size, e.g., comprising a 512 × 512 matrix of cells, that there is a considerable variation in the threshold for signals to accomplish the writing of information. This variation is related, in part, to the position on the panel of a cell being selected. Thus, in particular, in the Owens-Illinois panels it has been a common experience that cells centrally located on the panel have, in general, a higher threshold for writing. This may be explained in part by the fact that such cells are especially remote from the border keep-alive cells, and therefore from a ready source of radiation, photoelectrons and other ions.

It is therefore an object of the present invention to provide an apparatus and method for improving the uniformity of voltages required to write information into (or otherwise address, e.g., erase or scan over) a selected cell in a plasma panel matrix.

While uniformity in writing voltages alone is desirable, it should be understood that any lack in this regard is not a matter of mere inconvenience. Thus, if a write voltage level is selected which is unusually high, so that it is sure that it will be sufficient for all cells in a matrix array, care must be exercised that spurious operation of non-selected cells is avoided. Thus, in recognizing that one must require at least a minimum threshold value while not exceeding a maximum value (to avoid crosstalk), it is clear that there exists a range of acceptable values for the write signals in a plasma panel display. Because not all panels manufactured have identical physical characteristics, (e.g., spacing between dielectric planes, aging characteristics, and the like), it is required that some allowable variability of voltage for the write signals be present. Thus, there must be an operating range or margin for such write signals to account for variability in particular panel characteristics. In addition to panel-to-panel variations, it will be understood that cell-to-cell variations for a given panel will also occur.

It is, therefore, a further object of the present invention to provide for the maximum possible writing (and erasing, etc.) voltage margins while reducing operating voltages and minimizing crosstalk.

SUMMARY OF THE INVENTION

In realizing the above and other objects to be detailed below, the present invention recognizes the fact that the timing of the emission of photoelectrons from the keep-alive cells is of considerable importance in determining the required write voltages at prescribed cells. Thus there is provided in accordance with one embodiment of the present invention apparatus for selectively delaying the application of sustain signals to the border keep-alive cells in a configuration like that described by Johnson and Schmersal in the above-cited paper. The particular delays introduced in activating the sustain circuitry for the keep-alive cells is determined by the position (address) of a particular cell to be addressed.

In accordance with the typical embodiments described in the sequel, it has been found that operating margins may be increased by a considerable amount as compared with the system described in the Johnson and Schmersal paper. In addition, it has been found possible to reduce the magnitude of the write signal required to address a particular plasma cell.

BRIEF DESCRIPTION OF THE DRAWING

These and other objects and features of the present invention will be described in connection with the attached drawing wherein:

FIG. 11 summarizes the relationship between the three most significant panel address bits and typical values for $\tau$;

FIG. 12 shows alternative circuitry for achieving desired values for $\tau$;

FIG. 13 shows a typical logic signal input for the circuit of FIG. 12 and illustrates the timing for such input signal relative to a panel address signal;

DETAILED DESCRIPTION

Figure 1:
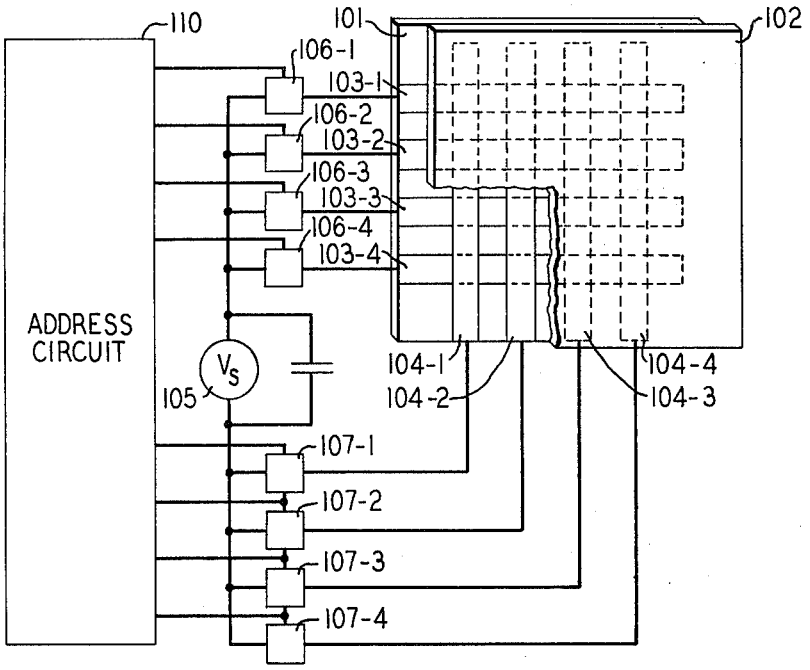
FIG. 1 PRIOR ART
FIG. 1 shows a prior art plasma panel including typical write-sustain electrical driving circuitry.

FIG. 1 shows a typical prior art plasma panel system. Thus there is shown a pair of spaced-apart dielectric layers 101 and 102 on which are laid, respective pluralities of horizontal and vertical electrodes **103-*i* and 104-*j*, $i,j = 1,2,\ldots,N$. While N for the panel shown in FIG. 1 is only 4, it should be understood that in general N is a considerably larger number, e.g., 512, as in the panel described in the Johnson and Schmersal paper, supra. Also shown in FIG. 1 is a sustain drive source 105. Sustain source 105 is, of course, the standard sustain drive source for applying the sustain signals to the respective X and Y electrodes. Application of the sustain signals is by way of X drive circuits 106-*i* and Y drive circuits 107-*j*, $i,j = 1,2,\ldots,N$. Also applied to X and Y drive circuits 106*i* and 107-*j* are signals emanating from address circuit 110. Address circuit 110 may, of course, be any standard addressing circuit capable of selecting individual X and Y electrodes. The addressing signals from circuit 110 are, of course, those appropriate when a write or an erase signal is to be applied to the cell defined by the intersection of a particular pair, or particular pairs, of electrodes 103-*i* and 104-*j***.

The operation of the circuit of FIG. 1 is substantially similar to that described in U.S. Pat. No. 3,761,773 issued Sept. 25, 1973 to Johnson and Schmersal. Alternative drive circuitry for realizing the circuits shown in FIG. 1 is given, for example, in Dick, "Low Cost Drivers for Capacitively Coupled Gas Plasma Display Panels," *Proc. of the S.I.D.*, Vol. 13, No. 1, First Quarter 1972, pp. 6–13, and in U.S. Pat. No. 3,689,912 issued to G. W. Dick on Sept. 5, 1972.

Figure 2:
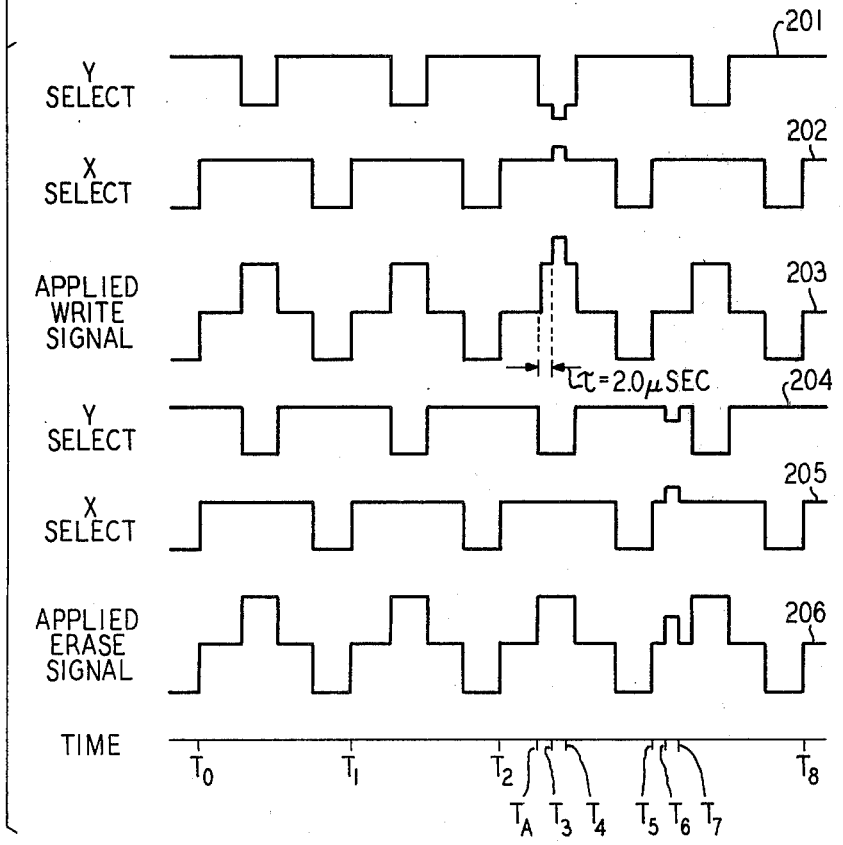
FIG. 2 shows typical pulse sequences, and combinations thereof, for the sustain pulse source 105 and the address circuit 110 in FIG. 1.

In FIG. 2, waveform 201 is representative of the Y select signal applied to a particular one of the column electrodes **104-*j* in FIG. 1. Similarly, waveform 202 is the waveform applied to a typical X or row electrode in FIG. 1. Waveforms 201 and 202 indicate the normal sustain sequence and, in addition, contain in the interval from $T_3$ to $T_4$ partial write signals. Waveform 203 represents the combined effect of the signals 201 and 203** as experienced by a particular selected plasma display cell. It should be understood that in typical sustain operation, e.g., from $T_0$ to $T_1$ or $T_1$ to $T_2$, no write or erase signals are present, so that on cells remain on, and off cells remain off. In the interval from $T_2$ to $T_5$, however, it is noted that the partial write signals occurring in the interval from $T_3$ to $T_4$ are additive, and are superimposed on the normal sustain waveform. The effect of this, of course, is to cause a breakdown at the selected cell which otherwise would not occur upon application of the sustain signal alone. After the interval $T_3$ to $T_4$ and upon the application of the normal sustain signal, e.g., that applied during the interval from $T_0$ to $T_1$, the selected cell will remain in the on condition.

Waveforms 204 to 206 show a typical operating pulse sequence to effect the erase of a particular cell, i.e., the extinction of an on cell. As is seen in the interval from $T_0$ to $T_1$ and $T_1$ to $T_2$, the normal sustain pulse sequence is applied to the selected cell. This continues, in fact, through the period $T_2$ through $T_5$. However, in the interval from $T_6$ to $T_7$ the partial erase pulses indicated as included in waveforms 204 and 205 combine to produce the waveform 206, thereby to effect an erase of the selected cell.

It should be understood, of course, that the designation X or Y for a particular coordinate direction or waveform is quite arbitrary; the roles for X and Y quantities may be interchanged as desired.

Figure 3:
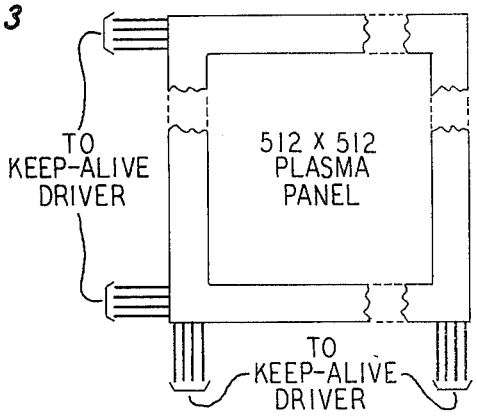
FIG. 3 shows the positions of keep-alive cells on a typical prior art plasma display panel.

FIG. 3 shows a prior art plasma panel typified by that described in the previously cited Johnson and Schmersal paper. In the representation in FIG. 3 only the four topmost and bottommost X electrode leads are shown explicitly. Similarly, only the four leftmost Y electrode leads and the four rightmost Y electrode leads are shown. The plasma cells defined by the leads shown in FIG. 3 and associated orthogonal electrode leads are the keep-alive cells previously mentioned. These keep-alive plasma cells therefore form a band, here four cells wide, around the entire panel.

As indicated in FIG. 3, the leads connected to the keep-alive cells are connected to keep-alive sustain signal sources (which comprise respective X and Y drivers substantially identical to those shown in FIG. 1 as 106-i and 107-j). Of course, since information will not be arbitrarily written in the keep-alive cells, i.e., they will be on at all times when the panel is in use, there need not be an address circuit of the usual kind. Instead, there is typically used a high-voltage source responsive to the initial turn-on of power for the display panel which drives the keep-alive plasma cells to their initial on condition. This special high-voltage signal is typically derived in standard fashion from circuits equivalent to the write address circuits shown in FIG. 1. After initial turn-on, drive circuits like those shown in FIG. 1 by the blocks 106-i and 107-j maintain the keep-alive cells on the plasma panel in this on condition.

While the four rows and columns of cells defining the border of the plasma panel of FIG. 3 are illustratively chosen to be keep-alive cells, there may in other appropriate cases be a greater or lesser number of such keep-alive cells. Because the prior art keep-alive cells remain in the on condition whenever the panel is in use, no addressing is required of the drive circuits for these keep-alive cells. Further, since the need to avoid spurious ignition of the keep-alive cells does not exist, they are typically driven by separate sustain signal sources and associated drivers which may apply a somewhat higher voltage than the normal sustain drivers.

In operating the plasma panels of the type shown in FIGS. 1 and 3, e.g., a plasma panel with a 512 × 512 matrix of plasma cells, it has been found that the operating voltages required to accomplish a write operation vary considerably according to the distance of the selected cell from the keep-alive cells shown in FIG. 3. As mentioned previously, in commercial panels it has been the custom to synchronize the write pulse for all selected cell locations with the keep-alive sustain pulse in a fixed manner. Typically, the delay, $\tau$, from the occurrence of the light pulse produced by the positive portion of the keep-alive sustain signal and the application of the write pulse to the addressed cell is equal to 2.0 microseconds for all cells. See FIG. 2, waveform 203. In other cases, a value of $\tau = 0$ might be chosen. In any event, $\tau$ assumes a fixed value for all panel locations in prior art systems.

Figure 4:
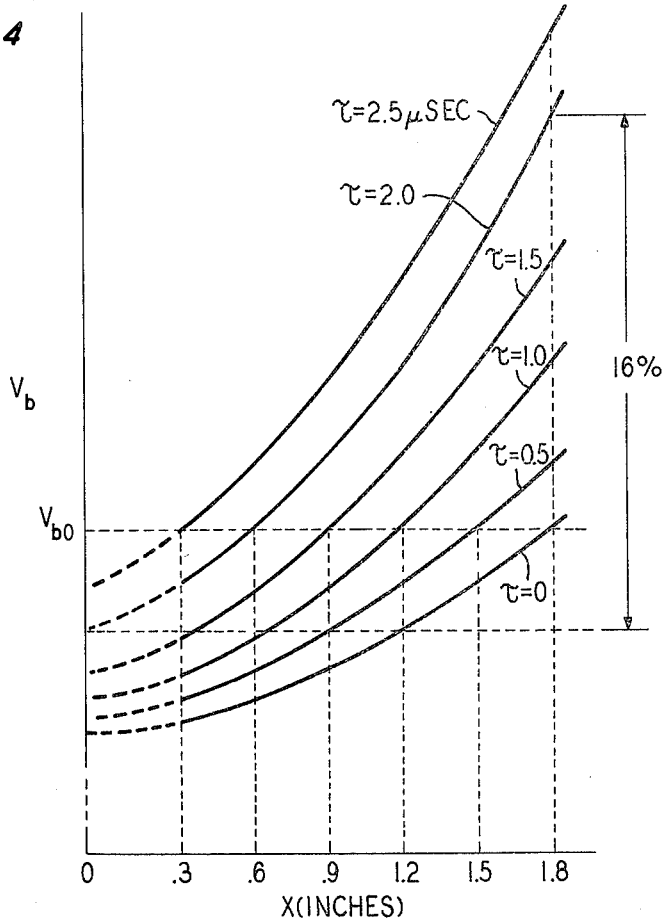
FIG. 4 shows the breakdown voltage $V_b$ as a function of separation of a given cell from the keep-alive cells, for a variety of keep-alive cell light pulse times (relative to addressed cell write pulse times)

FIG. 4 shows the relationship between the breakdown voltage $V_b$ of a plasma cell as a function of the separation from the nearest band of border (row or column) keep-alive cells, each band typically being 4 cells wide. Thus, in the case $\tau = 2.0$ microseconds, it is seen that there is a variation between the cells closest to the keep-alive cells and those separated by 1.8 inches (approximately the center of a 4 × 4 inches panel) of approximately 16 percent. It will now be shown that this variation in the breakdown voltage for a number of spaced apart cells gives rise to crosstalk.

If we consider first the "erase crosstalk," i.e., that giving rise to spurious cell erasures, we can see that the conditions indicated in FIG. 4 indicate a great likelihood of such erasure. In particular, if we consider that the full-select erase signal in current commercial panels is approximately 140 volts and the half-select write signal is approximately 130 volts, then it is clear that if the write signal (half-select) should be increased by more than 8 percent to reach a particular $V_b$ level at the center of the panel, then it will be possible for this same write signal to erase a number of cells around the periphery of the plasma cell, i.e., at $X = 0$ in the terminology of FIG. 4. This can be seen by the fact that $V_b$ for those cells near $X = 0$ is 16 percent lower than that at the center of the assumed 4 × 4 panel.

In addition, it is possible that "write crosstalk" may occur. This follows from the fact that $V_b$ for a cell increases approximately linearly in proportion to its distance X from the nearest keep-alive source. It is possible for the required $V_b$ for a center cell to be double that of the value of $V_b$ for a value of $X = 0$. Thus the half-select write pulse chosen for the center cell may be inadvertence write into a location defined by that same X drive line, but located near the keep-alive cell, i.e., at $X = 0$.

Figure 5:
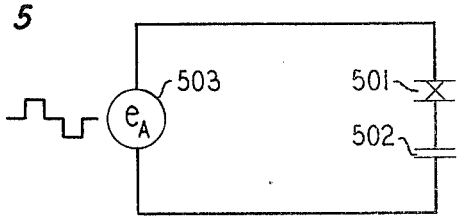
FIG. 5 shows a typical equivalent circuit representation for a plasma cell connected to a source of sustain signals.

Finally, it is possible that so-called "sustain crosstalk" may occur. To facilitate an understanding of this phenomenon, it is useful to consider the schematic circuit shown in FIG. 5, which is representative of a typical plasma discharge cell. Thus a source of sustain signals having a maximum value of $\pm e_A$, 503, is shown connected across the series combination of elements 501 and 502. Element 501 is, of course, the variable impedance component of the plasma cell associated with the breakdown of the gas in the cell. Element 502 represents the wall capacitance (i.e., the memory or storage element, in large part) of the plasma cell. Suppose that the cell in question in FIG. 5 represents a cell remote from the keep-alive source in a panel like that shown in FIG. 3. It is clear from FIG. 4 that a rather large value of $V_b$ may be required to effect a desired writing at the cell under discussion. When the total write voltage, i.e., the composite of the sustain pulse with a write pulse of magnitude $e_W$ superimposed on it, has a fixed maximum value, $e_A + e_W$, and the breakdown voltage $V_b$ is large, then it has been found that the capacitance represented in FIG. 5 by the element 502 charges to a markedly smaller value than is desired. Thus, the "memory" is reduced. This may be represented quantitatively by the relation $$(e_A + e_W - V_b) = KV_m,$$

where $V_m$ is the capacitor voltage across capacitor 502 in FIG. 5 and $K$ is a constant. In the succeeding half cycle after the initial write breakdown has occurred, it is required that the voltage on capacitor 502 in FIG. 5 add to the normal sustain pulse, now of opposite polarity, to form a voltage large enough to again breakdown the gas cell represented as 501 in FIG. 5. It should be clear that if $V_m$ is not sufficiently large to add to the applied sustain signal to cause a gas breakdown, that the actual sustain operation will not occur, i.e., the cell will not be reignited. This condition, which occurs when $V_b$ is large, corresponds to the sustain crosstalk effect mentioned above.

It can readily be appreciated that the crosstalk effects described above have been overcome in prior art systems only with a careful adjustment of all panel voltages within allowable margins. It can also be appreciated that panel-to-panel and cell-to-cell variations will create rather stringent margin constraints for operating voltages for production models of plasma panels of the type described. To minimize the susceptibility of panels to crosstalk effects, it has, therefore, been necessary in the prior art to impose rather strict tolerances on materials and manufacturing processes used to fabricate such panels. The production yield for panels of even modest size has accordingly been relatively low and the average fabrication cost high.

To correct the shortcomings of the prior art plasma panels with respect to the very narrow margins encountered in even moderate size plasma panels, the present invention provides means for varying the relative timing between the keep-alive sustain pulse and its resulting light pulse and the applied write pulse, i.e., by selectively varying $\tau$. In FIG. 4 there is identified a point on the $\tau = 2.0$ $\mu$sec curve (corresponding to the typical commercial panel delay), a value for $V_b$ equal to $V_{b0}$. This voltage $V_{b0}$ is seen to be sufficient for a value of $\tau = 2.0$ microseconds to satisfactorily operate cells remote from the keep-alive cells by a distance of approximately 0.6 inches. Of course, any cells closer to the keep-alive cells than 0.6 inches will also satisfactorily operate with a value of $\tau = 2.0$ $\mu$sec and $V_b = V_{b0}$. If the voltage used to write a cell is maintained at $V_{b0}$ and the cell is located a distance, say 1,2 inches from the keep-alive cells, it is clear that the cell will not operate if $\tau$ is maintained at 2.0 microseconds.

If, however, $\tau$ were to be modified to be equal to 1.0 $\mu$sec, then for the given value $V_{b0}$, it is clear that the cell at X = 1.2 inches would be sufficiently stimulated to turn to the on condition. Similarly, if values of $\tau =$ 0.5 $\mu$sec and 0 are chosen as shown in FIG. 4, it is clear that the voltage may again be maintained at $V_{b0}$ while writing into cells located at distances of 1.5 and 1.8 inches, respectively, from the keep-alive cells.

It should also be clear that introducing a variability to $\tau$ not only makes it possible to use the lower voltage $V_{b0}$ for all cells, but also gives rise to wider operating margins for all cells in the array within the 1.8 inch interval.

As noted above, the write and erase pulses are typically synchronized with the normal (main array) sustain pulse sequence. Additionally, since the sustain drivers for the keep-alive cells may be derived at least in part from a separate signal source, it is preferable to vary $\tau$ by controlling the operation of the keep-alive drivers. That is, the most effective manner of changing the relative timing $\tau$ between the keep-alive cell (sustain) firing and the main panel write pulses proves to be the shifting of the keep-alive cell sustain pulses.

Figure 6:
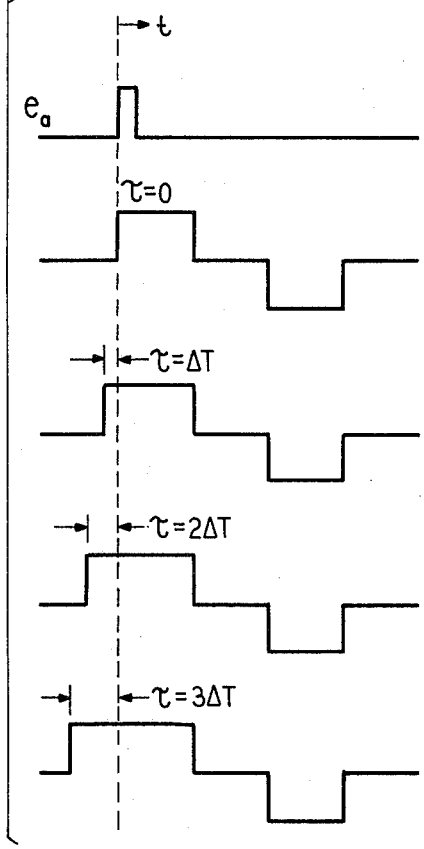
FIG. 6 shows typical modified timing for keep-alive cell sustain signals in accordance with one aspect of the present invention.

In modifying the value of $\tau$ in the above manner, it has proven convenient to choose four values for $\tau$, viz., $\tau = 0, \Delta T, 2\Delta T$, and $3\Delta T$. Further, it has proven convenient in accordance with one embodiment of the present invention to modify the keep-alive sustain signal by "stretching" its duration as indicated in FIG. 6. The top waveform represents a typical write (or other address pulse), $e_A$, which is superimposed on the main panel sustain signal. The remaining four waveforms indicate the varying amounts of required stretching of the sustain pulse for the keep-alive cells. Actually, as shown in FIG. 6, only that pulse occurring during the half cycle in which the address pulse occurs need be stretched. For convenience of explanation, the discharge resulting from a given keep-alive sustain pulse will be assumed for the present to occur simultaneously with the beginning of that pulse.

Figure 7:
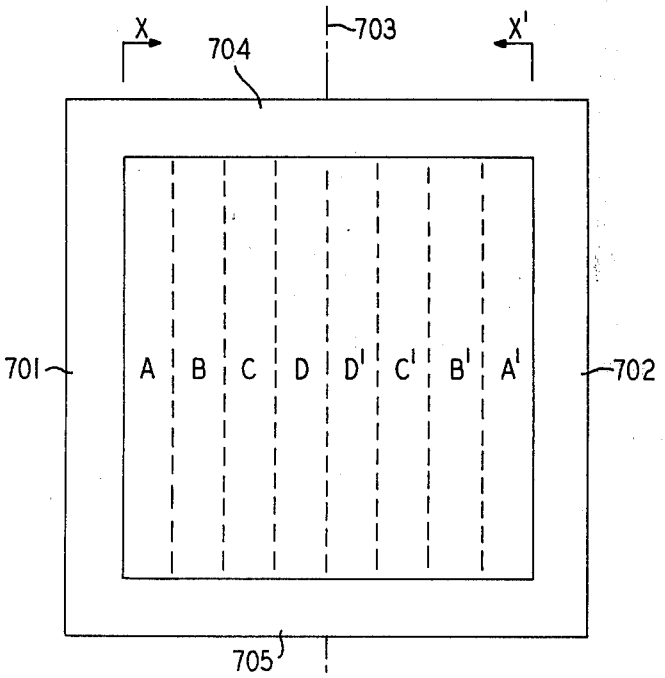
FIG. 7 illustrates a division of a plasma panel into useful bands of cells.

Each of the four values for $\tau$ shown in FIG. 6 is conveniently associated with a respective one of four segments in each half panel. The individual segments in a given pair of segments (one in each half panel) associated with a given value of $\tau$ are located symmetrically with respect to the panel center. That is, it proves covenient, for initial descriptive purposes, to divide a plasma panel of the type commercially available from Owens-Illinois into eight separate bands as shown in FIG. 7. The bands A, B, C, and D in FIG. 7 represent columns of cells successively more distant from the keep-alive cells maintained in an on condition along the left margin or edge 701. Specifically, they represent positions of increasing values for the coordinate X shown in FIG. 7.

Bands A′, B′, C′, and D′ are mirror image equivalents of the bands A, B, C, and D as reflected about the centerline 703. The A′, B′, C′, and D′ bands, of course, represent bands of cells whose X′ coordinates are of increasing significance in the nomenclature of FIG. 7. Thus, it is clear that the cells in the C′ band suffer from remoteness from the border keep-alive cells 702 to substantially the same degree as cells in the C band suffer from remoteness from keep-alive cells 701. The adverse effects of remoteness from keep-alive cells along borders 704 and 705, and means for correcting such effects, will be considered subsequently; it will be assumed, for present discussion purposes only, that there are no keep-alive cells along borders 704 and 705.

It should be readily apparent that for a 512 × 512 plasma panel, any particular cell can be addressed by two nine-bit binary words, one defining X position, and one defining Y position. Further, in the most obvious addressing scheme, measuring cell location from the extreme left edge, i.e., X = 0 in FIG. 7, the most significant of the nine address bits will designate which half of the display panel (left or right) in FIG. 7 is to be accessed. Similarly, for a given value, say 0, for the most significant bit, the 2nd and 3rd most significant bits will determine which of the bands A, B, C or D will be selected. It should be clear that the symmetry relationship between bands A and A′, B and B′, C and C′, and D and D′ dictates that the 2nd and 3rd most significant bits also determine the band selected when the most significant bit is a 1, i.e., when the right half of the panel is addressed. Circuitry in accordance with one aspect of the present invention exploits these relationships in a manner to be described below.

Figure 8:
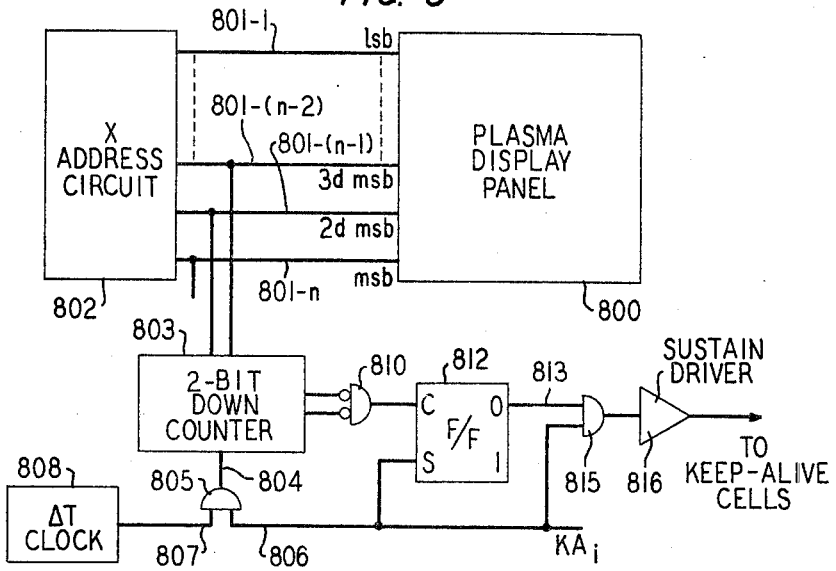
FIG. 8 illustrates one embodiment for circuitry for generating keep-alive sustain signals which are selectively spaced in time by an amount $\tau$ relative to a standard write pulse in response to address signals identifying one of the bands shown in FIG. 7.

FIG. 8 shows an overall organization for accomplishing the selective elongation of certain of the sustain pulses applied to the keep-alive cells as indicated in FIG. 6. In particular, there is shown in FIG. 8 a plasma display panel 800 to which are connected in standard fashion the plurality of addressing leads 801-*i*, $i = 1,2, \ldots, n$, emanating from the X select circuit 802. As indicated in FIG. 8, lead 801-1 is the least significant bit, and lead 801-*n* is the most significant bit. The signal on lead 801-*n*, then, indicates which half panel is selected. Correspondingly, leads 801-(*n*-1) and 801-(*n*-2) dictate the one of the four bands in the half panel in which a selected cell appears. At each addressing interval these band-indicating leads 801-(*n*-1) and 801-(*n*-2) apply their signals to a two-bit counter 803. The binary pair is loaded in parallel into counter 803, which is advantageously arranged to be a down counter capable of being decremented in response to pulses delivered on lead 804.

Figure 9:
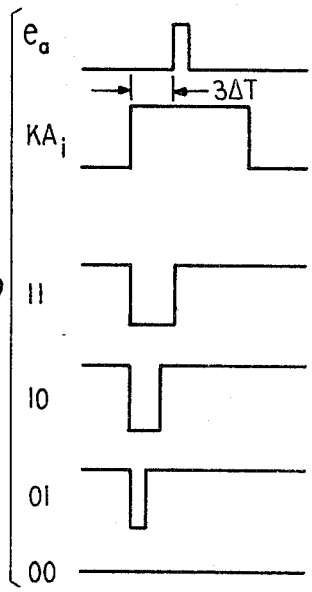
FIG. 9 compares typical output signals from the circuit of FIG. 8 with input and write signals.

Turning briefly to FIG. 9, we see a normal addressing pulse indicated as $e_a$. This pulse is assumed to be destined to establish an identified cell in the on condition, i.e., it is a write pulse. Beneath this is a control signal, $KA_i$ corresponding to a stretched version of the normal X sustain waveform, where stretching corresponding to $3\Delta T$ has been effected. Note that the positive portion of the waveform $KA_i$ commences at a time $3\Delta T$ seconds before the onset of the address pulse. Thus in the terminology discussed above, in connection with FIG. 6, the waveform $KA_i$ represents the maximum elongation of the sustain waveform, $\tau = 3\Delta T$. It should be borne in mind, however, that the waveform $KA_i$ is not the high current sustain drive signal itself, but rather a control signal of corresponding waveform suitable for operating logic circuits.

In FIG. 9, $\tau$ is shown as the time between the onset of the signal controlling the onset of the X keep-alive sustain signal and the write pulse superimposed on the sustain signals applied to the addressed cell. This is a matter of convenience to explain the operation of the circuitry for varying $\tau$. Actually, it will be understood that this keep-alive sustain control signal $KA_i$ will commence slightly earlier than $3\ \Delta T$ before the beginning of the write pulse. This slight amount of time, $\delta$, is the time necessary to cause the keep-alive cell discharge to take place. The definition of $\tau$ given above, it will be recalled, refers to the spacing between the light pulse from the keep-alive cell (and, of course, the photoelectrons, etc.) and the occurrence of the write pulse. However, since the time $\delta$ is a constant, it merely further lengthens $KA_i$ to commence $3\Delta T + \delta$ before the write pulse. For convenience only, the value of $\delta = 0$ will be assumed in the sequel unless otherwise noted. This was also true, of course, for FIG. 6.

Returning now to FIG. 8, we see that AND-gate 805 is arranged to deliver on lead 804 a signal representing the ANDing of a sequence of pulses at $\Delta T$ clock intervals, which originates in clock circuit 808 and is delivered to AND-gate 805 on lead 807, with the signal $KA_i$ on lead 806. The signal $KA_i$ appearing on lead 806 is also applied to flip-flop 812, thereby effecting a setting of flip-flop 812.

As should be clear from FIG. 8, the pulses delivered on lead 804 to counter 803 cause the counter 803 to be decremented until the 00 condition is reached. At this time AND-gate 810 causes flip-flop 812 to be cleared, i.e., set to the 0 condition. The resulting signal appearing on lead 813 from flip-flop 812 is applied to AND-gate 815. The other input to AND-gate 815 is the signal $KA_i$ appearing on lead 806. The output of AND-gate 815 is, in turn, applied to a sustain driver 816 of the normal variety described above. This driver 816 is that arranged to drive the electrodes of the keep-alive cells along the left and right borders of the plasma display panel 800. The bottom four waveforms in FIG. 9 show the waveforms applied on lead 813 to gate the control waveform $KA_i$.

In the terminology of FIGS. 1, 2, and 3 the altered keep-alive sustain signals are Y sustain signals. That is, they are like waveform 201 in FIG. 2 except for the earlier or later time of occurrence of the negative-going transition (for the particular cycle during which an addressing occurs), and the absence of any write signals superimposed thereon. Again it is noted that the keep-alive cell electrodes driven by the sustain driver 816 are those energized during the half cycle during which the address pulse $e_a$ in FIG. 9 is superimposed on the normal sustain pulses supplied to the display (non-keep-alive) cells in the array. The sustain pulses supplied to the normal display cells need not be altered. Similarly, no alteration need be made to the sustain pulses supplied to the keep-alive cells during the half cycles when no address pulses are presented, i.e., in the terminology of FIG. 2, the X sustain pulses to the keep-alive cells need not be modified.

Figure 9A:
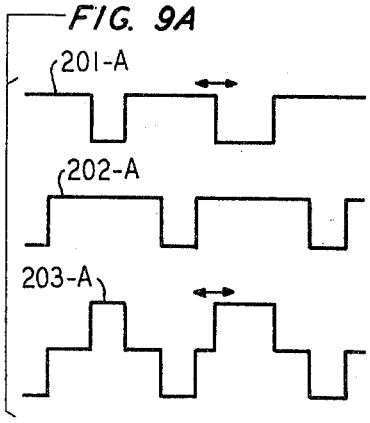
FIG. 9A shows the formation of a shifted sustain pulse based on the operation of the circuit of FIG. 8.

The effect of the circuitry of FIG. 8, then, is to generate one of the waveforms shown in FIG. 6, depending upon the count stored in counter 803, or, what is equivalent, the address supplied by X select circuit 802 to the plasma panel 800. FIG. 9A shows the result of modifying a Y electrode sustain signal. Waveform 201-A is based on that shown as 201 in FIG. 2. The first lower level pulse in waveform 201-A is identical to that normally occurring in waveform 201, but the second pulse begins prematurely because of the operation of the circuitry of FIG. 8. In general, the leading edge of this lower level pulse is variable, and is dependent on the address selected. This variability is indicated by the left-right arrow over waveform 201-A in FIG. 9A. When this variable-position pulse waveform is algebraically combined with a fixed time X electrode sustain waveform, it produces the variable-position pulse waveform indicated by 203-A in FIG. 9A.

It should be clear that the arrangement described above in connection with FIG. 8 will be appropriate when the left half of the plasma panel shown in FIG. 7 is accessed. That is, the selection of the proper value of $\tau$ will be accomplished by processing the second and third most significant digit signals as described. When, however, an addressed cell is in the right half of a plasma panel like that shown in FIG. 7, it proves necessary to provide alternative means for setting the two-bit counter 803.

Figure 10:
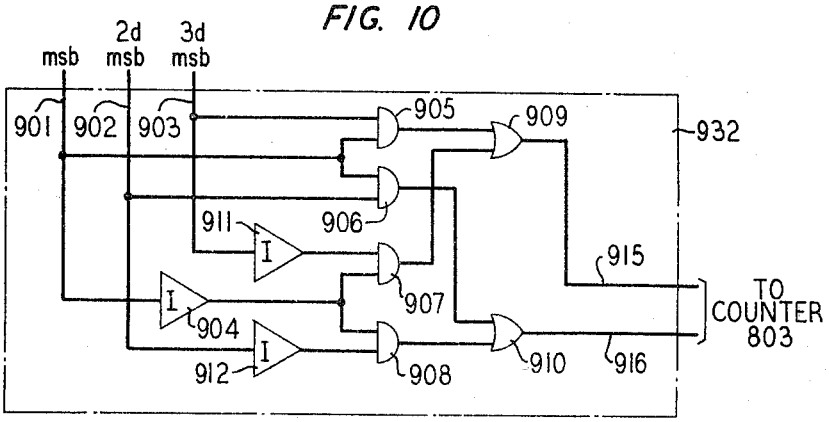
FIG. 10 shows modifications to the circuitry of FIG. 8, extending the utility of the latter over the entire plasma panel.

In particular, a signal indicative of the most significant digit in a desired address is applied on lead 901 to circuitry in accordance with FIG. 10. This most significant bit position signal is in addition to the second and third most significant bit signals applied on leads 902 and 903, respectively. The signal on lead 901 is, in turn, inverted by inverter circuit 904 to generate the complement of the most significant bit signal. Thus, depending on whether the most significant bit is a 1 or 0, one of the pairs of AND gates 905, 906 or 907, 908 will be selected.

AND-gate 906 supplies an unmodified version of the second-most-significant-bit signal (that on lead 902) to lead 916, by way of OR circuit 910 whenever the signal on lead 901 is a 1. When this latter signal is a 0, the signal on lead 902 is inverted by inverter circuit 912 and supplied to lead 916 by way of OR circuit 910. Similarly, either the signal on lead 903 or an inverted version of it is supplied to lead 915, according to whether the signal on lead 901 is a 1 or a 0. In effect, the circuit 932 in FIG. 10 functions as a special purpose address decoder.

Thus there are supplied on leads 915 and 916 the appropriate address-related signals designating bands on a panel as shown in FIG. 7 that reflect relative remoteness from the nearest row of keep-alive cells. The signals on leads 915 and 916 are, of course, those applied in parallel to counter 803 in FIG. 8. FIG. 11 summarizes the possible bit patterns and the resulting values for $\tau$.

It occurs, in some instances, that the disparity in positive and negative keep-alive sustain pulse widths as shown in FIG. 6 creates an undesirable imbalance in corresponding positive and negative wall charges for the individual plasma cells. To avoid this, the circuitry of FIG. 12 may be used to achieve the desired relative timing between keep-alive cell sustain signals and addressed cell or write or erase signals. A standard logic level keep-alive sustain control signal having the waveform and relative spacing from the addressed cell write signal $e_A$ shown in FIG. 13 is applied to lead 950 in FIG. 12. No elongation of this control pulse is required, only the indicated time shifting relative to the address pulse. As with in circuits of FIGS. 8 and 10, the address signals present in address circuit 802 are processed, or decoded, by a decoder 932 to generate signals specifying the required value for $\tau$.

When a maximum value of $\tau = 3\Delta T$ is indicated (a 00 bit pair on leads 930 and 931) AND-gate 951 permits the KA signal on lead 950 to pass to keep-alive sustain driver 959 without additional delay. Since the signal on lead 950 is already positioned in time as indicated by the waveforms in FIG. 13, the required $\tau = 3\Delta T$ value will be achieved. When a value of $\tau = 2\Delta T$ is indicated by a 01 pattern on leads 930 and 931, AND-gate 952 is selected. This causes the KA signal on lead 950 to be delayed in delay unit 955 by an amount equal to $\Delta T$, but otherwise to remain the same. This causes the time spacing between the KA signal and the $e_A$ signal (which remains unaffected) to be reduced by $\Delta T$. Thus the desired $\tau = 0$ $2\Delta T$ value is achieved. Similar selection and delay operations are performed by gates 953 and 954, and corresponding delay units 956 and 957 to achieve, respectively, values of $\tau = \Delta T$ and $\tau = 0$. Since the KA signal is arranged to be of duration sufficient to cause the sustain driver 959 to generate a low level for the same time as the normal Y-sustain driver, and since addresses have no affect on this duration, the above-mentioned imbalance does not occur when the circuit of FIG. 12 is used. The operation of the circuit of FIG. 1 when no addressing is to occur is the same as in the unmodified commercial panels.

The above descriptions concerning values of $\tau$ and means for deriving them have, of course, been limited to the case where keep-alive cells are present only along two sides of a plasma panel. In the more usual case, e.g., that described in the above-cited paper by Johnson and Schmersal, the keep-alive cells are present around all four sides of the panel as shown in FIG. 3. The distance of a given cell on the panel matrix from sources of keep-alive photoelectrons, other ions and photons is therefore a function of both X and Y coordinates. Thus rather than considering only bands like those shown in FIG. 7, one profitably considers square areas as shown in FIG. 14.

Figure 14:
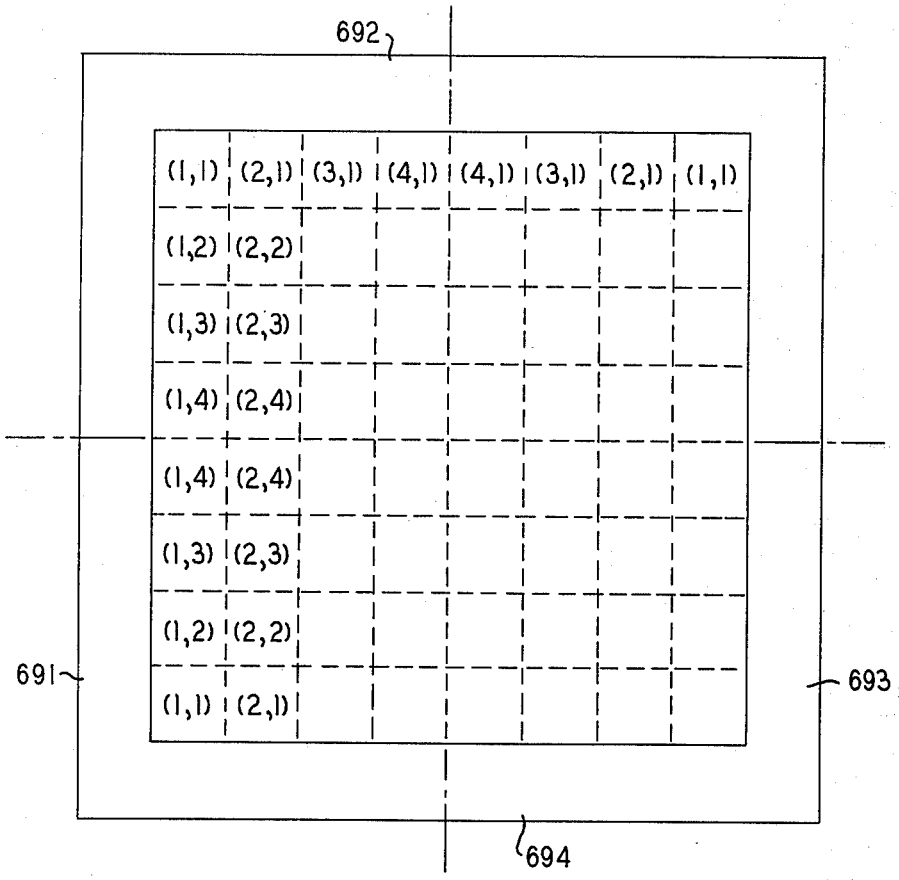
FIG. 14 illustrates an extension of the bands of FIG. 7 to two-dimensional segments.

In FIG. 14, a panel like that shown in FIG. 7 is shown divided into eight vertical and eight horizontal bands defining 64 squares. Each square may be identified by a two-couple $(i, j)$ indicating the distance $i$ from the nearest band of vertical keep-alive cells and a distance $j$ from the nearest band of horizontal keep-alive cells. Thus for example, the square designated (2, 3) is located two positions to the right of keep-alive band 691 and three positions below keep-alive band 692. The numbers $i$ are of course those derived from the first, second and third most significant bits of the X address coordinate of a given cell, and may be derived using circuitry like that shown in FIG. 10. The numbers $j$ are similarly derived by circuitry like that shown in FIG. 10, but based on the three most significant bits of the Y address.

There are, of course, many ways in which the values for $i$ and $j$ may be used to determine the appropriate value for $\tau$ in accordance with the goals and techniques described above. From a strictly geometric viewpoint, a composite value for $\tau$ proportional to $(i^2 + j^2)^{1/2}$ might be used. However, the additional computational complexity, required to calculate $\tau$ on such a basis is not justified in most cases.

It has been determined that in a cell in a square like that designated (4, 1) at the top of FIG. 14 the keep-alive photon and photoelectron flux from the keep-alive cells along the left and right borders 691 and 693 has relatively little enhancing effect as compared to the flux from the keep-alive cells along the top border 692 in FIG. 14. In general, when keep-alive cells are located around the entire periphery, as in the panel described in the Johnson and Schmersal paper, supra, it proves convenient to ignore all but the closest set of border keep-alive cells in determining $\tau$. Thus while some contribution to enhanced main panel cell operation is made by all keep-alive cells, only the dominant contribution by the keep-alive cells nearest the addressed cell need be explicitly accounted for in setting $\tau$.

Figure 15:
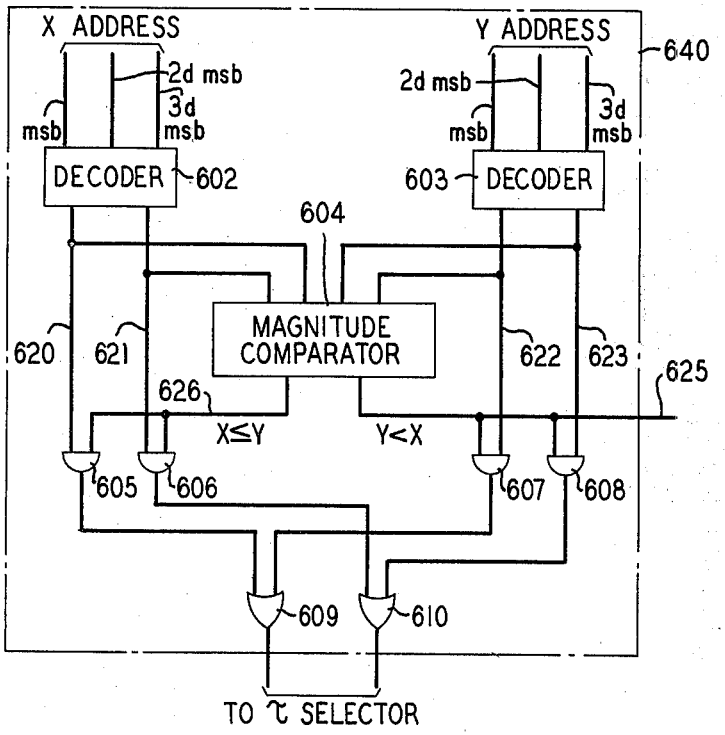
FIG. 15 shows circuitry for generating $\tau$-specifying signals for keep-alive cells located on either the horizontal or vertical borders of a plasma panel.

FIG. 15 illustrates circuitry for determining the appropriate value for $\tau$ when keep-alive cells are located along all sides. Again assuming that one of four possible values of $\tau$ will be selected, the problem reduces to one of comparing a function of the second and third most significant bits for the X and Y address of a cell to be addressed. As described previously in connection with the circuit of FIG. 10, a bit complementing is performed when a coordinate is identified by an address having a 1 as the most significant bit. Thus a pair of decoders like circuit 932 in FIG. 10 are used to derive the function of the second and third most significant bits which define the remoteness of a (horizontal or vertical) band of cells from the nearest parallel band of keep-alive cells. This pair of decoders includes circuits 602 and 603 in FIG. 15, corresponding to an X decoder and a Y decoder, respectively.

When decoders 602 and 603 have respective X and Y address bits applied to them, they generate on lead pairs 620 and 621, and 622 and 623 signals indicative of the distance from the relevant (nearest) border for each of the two coordinate directions. Comparator 604 then compares the bit patterns appearing on the lead pairs. If comparator 604 determines that the signals on leads 622 and 623 are lesser in magnitude (significance) than those on leads 620 and 621, a gating signal is generated on lead 625. This indicates that the cell selected is closer to a top or bottom edge of the panel than to a left or right edge.

If comparator 604 determines that the signals on leads 620 and 621 are lesser in magnitude than or equal to those on leads 622 and 623, then a gating signal is generated on lead 626. This indicates that the cell selected for addressing is closer to a left or right edge than to a top or bottom edge.

The signals generated on one of leads 625 or 626 allows the corresponding decoded signals on the associated address function lead pair to pass through AND gates 605 and 606 (for X-based signals), or AND gates 607 and 608 (for Y-based signals). The gated signals then pass by way of OR circuits 609 and 610 to a counter like 803 in FIG. 8. Thus the appropriate address-related signals are used to control the gating of the sustain drivers for all of the keep-alive cells. As noted above, the dominant contribution to discharge enhancement will be made by the nearest band of keep-alive cells, though all others (with the same value for $\tau$) will contribute to some degree.

Figure 16:
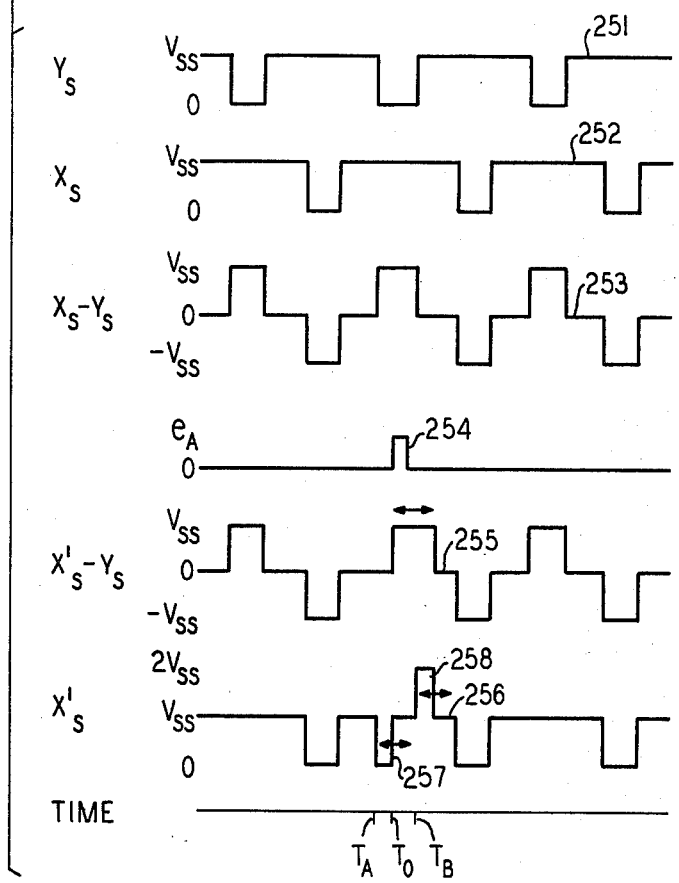
FIG. 16 shows waveforms associated with modified border keep-alive sustain signals.

The exact manner in which the sustain signals having the selected value for $\tau$ are impressed on the keep-alive cells will now be described. Reference to FIG.16 will prove useful in this regard. The top two waveforms 251 and 252, in FIG. 16 are the Y and X sustain signals applied, when no addressing is to occur, to the keep-alive cells along the periphery of a panel of the type described above. The coincident application of these signals, algebraically added as X-Y, yields the effective signal 253 shown in FIG. 16.

As can be appreciated from FIG. 3, a keep-alive cell, say in the center of the column of cells along the left border, will be sustained in part, by a separate Y sustain signal applied at the bottom of the panel only to keep-alive cells. The corresponding X sustain signal will, however, be shared with other cells, including those on the main portion of the panel along the same horizontal row.

It will be recalled from the discussion above that only that portion of the keep-alive composite sustain signal which occurs during the same portion of the sustain cycle as that in which the address signal is applied to the main panel cell need be shifted or otherwise altered to create the appropriate interval $\tau$. Thus in the case of the cell in the center of the left border, it is the Y sustain pulse which must be shifted to properly coordinate the keep-alive firing with a write pulse. From FIG. 3, it is clear that separate access to the Y sustain lead may be had without altering the sustain pulses applied to the cells on the main portion of the panel. The sustain driver 816 in FIG. 8 may be connected directly to the Y sustain leads shown in FIG. 3 to achieve the desired result.

When, by virtue of the comparisons effected by the circuitry of FIG. 15, the top or bottom border keep-alive cells are found to be the ones which can contribute most effectively to the keep-alive effort, a slightly different approach is preferred. Since it is generally preferable to leave the main panel sustain and address signals unaltered, the signals required to be applied to the border keep-alive cells become slightly more complicated when the top or bottom border cells are dominant. In particular, since the address pulse, (here a combined full height write pulse) represented in FIG. 16 as 254, advantageously occurs during the time when the main panel Y sustain signal assumes its low value (see waveform 251), and since the Y sustain signal used by a typical cell near the center of the band of top border cells is typically the same as that used by the main panel cells, the required effective shift of the keep-alive cells must be achieved in a somewhat different manner.

It will be assumed that the border sustain cells occur in synchronism with the main panel sustain signals when no addressing is to take place, i.e., the top and bottom border cells will have X sustain signals like that shown in FIG. 16 by waveform 252 and the left and right border cells will have Y sustain signals like waveform 251 in FIG. 16. If no modification of the keep-alive cell sustain signals were to be made, and if the address pulse appeared as shown by waveform 254 in FIG. 16, a fixed effective value of $\tau$ of approximately 2 $\mu$sec would be realized. This 2 $\mu$sec interval is the period, e.g., from $T_A$ to $T_O$ in FIG. 16, based on an assumed 5 $\mu$sec duration for the $+V_{ss}$ pulse in waveform 253. Again, however, it should be recalled that, for convenience only $\tau$ is represented in the drawing of FIG. 16 as the time between the leading edge of the $+V_{ss}$ pulse in the keep-alive sustain signal and the onset of the write pulse. In reality, of course, $\tau$ is measured from the occurrence of the light pulse at the keep-alive cells. Since the keep-alive sustain pulse usually precedes the keep-alive cell light pulse by 0.5–1.0 $\mu$sec (0.7 $\mu$sec is typical), an actual value of $\tau = 1.3$ $\mu$sec would result from the pulse arrangements shown by waveforms 251–254 in FIG. 16. To get an actual value of $\tau = 2.0$ $\mu$sec, the low level pulse in waveform 251 would begin approximately 2.7 $\mu$sec before beginning of the write pulse 254.

To illustrate the operation of the present invention according to one embodiment, it will be assumed that a value of $\tau$=0 is dictated by the addressing of a cell at a top central location on the panel (e.g., one in square (4,1) in FIG. 14). This implies a composite waveform like that shown as 255 in FIG. 16. However, since the Y sustain signal 251 is not to be tampered with, it is required that the X sustain signal for the top and bottom border keep-alive cells must assume the form shown in FIG. 16 as 256. To avoid confusion with waveform 252 ($X_s$), waveform 256 is referred to as $X_s'$.

Figure 17:
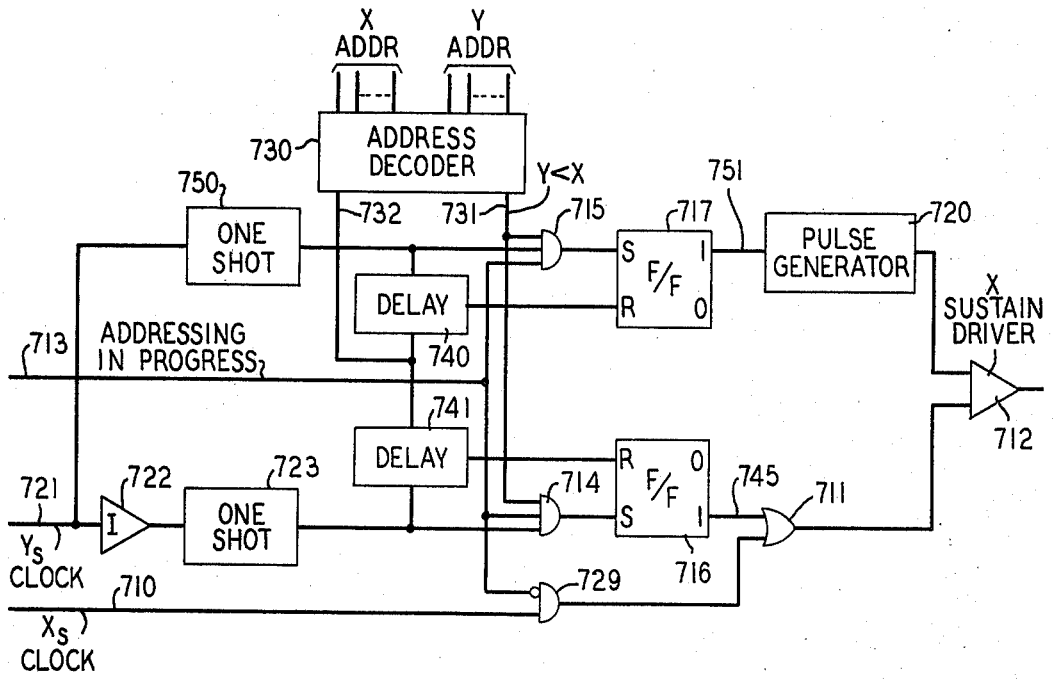
FIG. 17 illustrates a circuit for generating modified keep-alive sustain signals of the type illustrated in FIG. 16.

FIG. 17 shows a circuit for achieving the $X_s'$ waveform 256 shown in FIG. 16. Clock signals corresponding to the waveform $X_s$ applied on input lead 710 pass by way of OR circuit 711 to X sustain driver 712 to produce the $X_s$ drive signals for the horizontal electrodes of the top and bottom borders when no addressing is taking place. The $X_s$ clock signals on lead 710 are inhibited at AND gate 729 by the "addressing in progress lead" signal on lead 713. When an addressing operation is under way, as indicated by a positive logic level on lead 713, additional paths for modulating the output of X sustain driver 712 are provided. Specifically, AND gates 714 and 715 are gated on, thus permitting respective flip flops 716 and 717 to be set for intervals of time dependent on the location of the cell being addressed. Flip flop 716 in turn causes a signal to pass by way of OR circuit 711 to X sustain driver 712, thereby to generate a variable length pulse 257. Flip flop 717 gates pulse generator 720 to generate a variable length positive pulse 258 of magnitude $V_{ss}$. Advantageously, pulse generator 720 assumes the form of a write pulse circuit of substantially the same structure as is used in writing information into a cell in the main portion of the panel. Of course, different particular voltages will be used as indicated. Likewise, the additive coupling of the output of pulse generator 720 to X sustain driver 712 is of the same nature as is used in coupling write and sustain signals in the main panel writing process. For convenience of description, this combining is shown being accomplished in sustain driver 720, but a separate combining network using transformer coupling or any other standard means may be used. The result of superimposing the write pulse of magnitude $V_{ss}$ on the X sustain signal of magnitude $V_{ss}$ is a pulse of combined magnitude $2V_{ss}$.

Other detailed circuits for generating the composite waveform 256 (and earlier presented composite waveforms) will occur to those skilled in the art. Such techniques for generating and/or combining sustain and write (or other address) pulses are described in U.S. Pat. No. 3,777,182 issued Dec. 4, 1973 to Peters; U.S. Pat. No. 3,786,484 issued Jan. 15, 1974 to Miavecz; U.S. Pat. No. 3,786,485, issued Jan. 15, 1974 to Wojcik; U.S. Pat. No. 3,754,230, issued Aug. 21, 1973 to Auger; U.S. Pat. No. 3,689,912 issued Sept. 5, 1972 to Dick; U.S. Pat. No. 3,749,971 issued July 31, 1973 to Petty; and U.S. Pat. No. 3,754,161 issued Aug. 21, 1973 to Johnson; all of these patents are hereby incorporated by references as if set forth in their entirety herein.

The manner of setting and resetting the flip flops 716 and 717 will now be described. It will again be assumed that four possible values for $\tau$, viz., 0, $\Delta T$, $2\Delta T$, and $3\Delta T$ are desired. When an address operation is taking place the $Y_s$ clock signal on lead 721 (having the waveform shown as 251 in FIG. 16) is inverted by inverter 722 to generate a positive signal transition at time $T_A$. This positive going signal then triggers one-shot circuit 723 to generate a signal which passes by way of AND gate 714 to set the flip flop 716 beginning at $t = T_A$. The X and Y address signals meanwhile are applied to address decoder 730 which is of the type shown as 640 in FIG. 15. Note that the lead 731 in FIG. 17 (corresponding to the $Y < X$ lead 625 in FIG. 15) allows the pulse from one-shot circuit 723 to set flip flop 716 only when the $Y < X$ condition is met.

The output 732 from address decoder 730 is actually a pair of leads carrying the $\tau$ specifying bit pair to delay units 740 and 741. Delay unit 741 is of the pulse delay type shown as 970 in FIG. 12, but where the bit pair association with selected delays is

| bit pair | delay |
|---|---|
| 00 | $3\Delta T$ |
| 01 | $2\Delta T$ |
| 10 | $\Delta T$ |
| 11 | 0 |

Thus the pulse from one-shot circuit 723 passes through delay unit 741 where it is delayed in an address-dependent manner before resetting flip flop 716. When a 0 delay is introduced by delay unit 741 the flip flop is reset immediately after being set, i.e., the output on lead 745 remains at the 0 level. Any race conditions encountered, if found to be troublesome, can be eliminated by standard means, e.g., introducing a slight fixed delay in the path through gate 714, and applying the output of delay unit 741 to an inhibit input on gate 714. When a nonzero delay is introduced by delay unit 741, an output from flip flop 716 is generated on lead 745 which causes the X sustain driver 712 to generate a nonzero duration pulse like 257 in FIG. 16.

The positive-going transition of the $Y_s$ clock signal on lead 721 at time $T_B$ in FIG. 16 causes one-shot circuit 750 to supply a pulse by way of gate 715 to set flip flop 717. A selectively delayed replica of the pulse from one-shot circuit 750 is applied to the reset input of flip flop 717, thereby generating on lead 751 the required variable-length selection signal for pulse generator 720. Again, delay unit 740 is of the type shown in FIG. 12 as 970. The duration of the delay is, of course, controlled by the bit pair delivered on the lead (actually two leads) 732, and the bit-pair/delay controlling relationship is like that given above for delay unit 741. It should be understood, of course, that all that is required by way of modification to the circuit of FIG. 12 is to reorder the positions of the delay units 955, 956, 957 and the through path (zero delay) connected to the outputs of gates 951–954 in FIG. 12. That is, the gate 951 enables the $3\Delta T$ delay unit 957, the gate 952 enables the $2\Delta T$ delay unit 956, the gate 953 enables the $\Delta T$ delay unit 955, and the gate 954 has its output directly connected to OR gate 958.

By the means shown in FIG. 17 and described above, the variable width pulses 257 and 258 are superimposed on the $X_s$ signal 252 to generate the $X_s'$ signal 256. When the $X_s'$ and $Y_s$ signals are applied to the top and bottom border keep-alive cells, the composite variable position keep-alive sustain signal $X_s'$-$Y_s$ gives rise to the desired variable $\tau$. Larger values for $\tau$ than could ordinarily be obtained, $T_O - T_A$ is the largest indicated interval between the fixed occurrence of the write pulse and the onset of the sustain signal for the keep-alive cell. If this is reduced by $\delta$, the time between the sustain driver pulse leading edge and the actual firing of the keep-alive cell is at a maximum, $\tau = T_O - T_A - \delta$. (In some cases, however, $\delta$ may be sufficiently small as to be disregarded.) While this maximum value is sufficient for most applications, it can readily be increased by delaying the write pulse or, preferably, by advancing the $Y_s$ clock signal by an additional amount. The minimum value for $\tau$ is ordinarily 0, a value achievable by suitably choosing the increments $\Delta T$.

It will be appreciated from the foregoing that a significant relaxation of the present strict requirements for write signal levels may be achieved by using the present invention. Further, by easing one of the many critical and often conflicting constraints on plasma panel construction and operation, a greater tolerance for other non-optimum system parameters is achieved. Thus, for example, the uniformity of cell construction now required may be relaxed somewhat, thereby giving rise to higher manufacturing yields and lower overall cost. Because the criticality of write signals has been greatly reduced, less care need be taken in generating erase and sustain signals which would otherwise give rise to crosstalk problems.

While the more complete "coupling" between keep-alive and write signals has been emphasized in the preceding discussion, it is clear that an exactly equivalent coupling may be achieved between keep-alive and erase signals as well.

Further, such variable timing between the occurrence of other address signals, e.g., the scan pulse described in my copending application Ser. No. 345,893, filed Mar. 29, 1973, and the keep-alive sustain signals will also be obvious in light of the present disclosure to those skilled in the art. Though only eight (or four in the case of horizontal-only or vertical-only keep-alive bands) different values for $\tau$ were used, any number of values for $\tau$ greater than one may be used. These values of $\tau$ may, of course, be assigned to an increased or decreased number of bands or squares in the sense of FIGS. 7 and 14. The values of $\Delta T$, tyically 0.5 microseconds, may similarly be varied to accommodate panels of any particular size. The exact keep-alive waveforms are in no way critical to the use of the present invention. Thus for example, in FIGS. 12 and 13 the signal KA appearing on lead 950 may assume any standard keep-alive waveform shape.

While a simple selection of $\tau$ increments based on one of the X and Y addresses, as described above in connection with FIG. 15, has proven quite effective in coordinating write pulses and keep-alive cell operation, it is clear that more complicated linear or nonlinear functions of X and Y coordinates may prove advantageous in some cases. Such variations may be adopted for other than square panels, for example. That is, if the selection conductors should advantageously be relatively placed in a circular manner, e.g., positioned by polar coordinates $r$ and $\theta$, and the keep-alive cells placed in a circular band, only the radial coordinate might be used to determine the value for $\tau$.

In appropriate cases, non-pulsed keep-alive sustain signals, e.g., sinusoidal signals, may be used with variable delay i.e., phase, depending on the address of a location being written erased or otherwise accessed. Similarly, if all of the keep-alive cells are driven by both separate X and separate Y sustain circuits, many of the particular circuits described can be even further simplified.

While the typical structure used to illustrate the present invention has included a discharge panel utilizing the common spaced-apart conductor sandwich arrangement, other geometries including single-substrate constructions such as are illustrated in U.S. Pat. No. 3,646,384 issued Feb. 29, 1972 to Lay may profit from use of the present invention. Further, while uniform arrays of plasma display cells have been used as a vehicle for description, other more special purpose plasma devices may utilize the present invention. For example, cells in collections of cells defining letters or other characters, lines or other graphic entities may, either individually or collectively, be operated by conditioning signals having a time relation to addressing signals which are dependent on their position.

It should be clear, therefore, that the particular structure and operating sequences described above are merely typical. The central factor of variable time duration between conditioning signals, e.g., keep-alive light pulses and main panel addressing signals may be achieved in a variety of ways.

Further, while only plasma discharge devices have been described above, other devices which benefit from preconditioning signals derived from a more or less remote source will benefit from the application of the present invention. Similarly, while keep-alive plasma cells have been emphasized it should be clear that other sources of preconditioning flux used in prior art systems, e.g., pulsed ultra-violet light sources may also be operated in timed relation with the location of a location being addressed.

What is claimed is:

1. A display system comprising a panel of gas discharge display sites, means operative for applying addressing signals to selected ones of said sites, one or more preconditioning sources external to said sites, each of said sources being activatable to provide preconditioning flux at each of said sites to facilitate gas discharges thereat, means operative for activating one or more ones of said sources in a time relation with respect to the operation of said applying means, and means for varying said time relation as a function of the positions of said selected ones of said sites with respect to the positions of said one or more ones of said sources.

2. The system of claim 1 wherein each of said display sites comprises a discharge cell.

3. The system of claim 2 wherein each said discharge cell comprises a plasma discharge cell and wherein each of said sources comprises a source of ions.

4. The system of claim 3 wherein said sources comprise respective plasma discharge cells maintained in a repetitively discharging mode of operation.

5. The system of claim 4 wherein said display sites are located in a display area with each site at respective 2-dimensional coordinates, and wherein said plasma discharge cells maintained in said repetitive mode are positioned around the periphery of said display area.

6. The system of claim 1 wherein said means for varying comprises means for providing a closer time relation between the operation of said applying means and the operation of said activating means when said addressing signals are applied to sites more remotely spaced to identified ones of said sources and for providing a more remote time relation therebetween when said addressing signals are applied to sites more closely spaced to identified ones of said sources.

7. The system of claim 1 wherein said means for activating comprises means for generating activating signals in fixed time relation with respect to said addressing signals and wherein said means for varying includes means for selectively delaying said activating signals.

8. Apparatus comprising a body of ionizable gas, means defining a plurality of discharge cells each comprising a respective region of said ionizable gas, a plurality of keep-alive means activatable for creating preconditioning flux within said body of ionizable gas to facilitate discharges at said cells, means operative for activating said keep-alive means, addressing means operative at a variable interval subsequent to an operation of said activating means for applying addressing signals to a selected one of said cells, and means for varying said interval in accordance with the respective positions of said selected cell and said keep-alive means.

9. Apparatus according to claim 8 wherein said cell defining means comprises a plurality of conductors arranged in mutually orthogonal sets along rows and columns of a matrix, said cells being defined by the overlapping of a particular orthogonal pair of said conductors, said keep-alive means are each located in a fixed position relation to said matrix, and said means for varying comprises means for controlling the operation of said activating means in accordance with the position of said selected cell in said matrix.

10. Apparatus according to claim 8 wherein said keep-alive means comprise a plurality of keep-alive plasma cells.

11. Apparatus according to claim 10 wherein said activating means comprises means for applying sustain signals to said keep-alive cells, and wherein said varying means comprises means for controlling said activating means to apply said sustain signals at a time dependent on the position of said selected cell.

12. Apparatus according to claim 9 wherein said addressing means comprises means for applying a write signal to said selected cell to establish it in a light-emitting state.

13. Apparatus according to claim 12 wherein said addressing means further comprises means for applying sustain signals to maintain said selected cell in said light-emitting state.

14. Apparatus according to claim 9 wherein said addressing means comprises means for applying an erase signal to said selected cell to cause it to assume a non-light-emitting state after being addressed if it was in a light-emitting state prior to being addressed.

15. Apparatus according to claim 8 wherein said addressing means comprises means for writing information into said selected cell.

16. Apparatus according to claim 10 wherein said addressing means comprises means for erasing information from said selected cell.

17. Apparatus according to claim 10 wherein said addressing means comprises means for causing said selected cell to momentarily emit light.

18. Apparatus according to claim 9 wherein said keep-alive means comprise a plurality of keep-alive plasma cells disposed around the periphery of said matrix and wherein said varying means comprises (1) means for determining the remoteness of a selected cell from the nearest edge of said matrix and (2) means for controlling said activating means to apply sustain signals to said keep-alive cells at a time dependent on said remoteness.

19. In a display system comprising a panel of gas discharge display sites and one or more sources of preconditioning flux eternal to said sites, each of said sources being activatable to provide preconditioning flux at each of said sites to facilitate gas discharge thereat, a method comprising the steps of applying addressing signals to a selected ones of said sites, activating one or more ones of said sources in a time relation with respect to said applying, and varying said time relation as a function of the positions of said selected ones of said sites with respect to the positions of said one or more ones of said sources.

20. A method for use in a display system comprising a body of ionizable gas, means defining a plurality of discharge cells each comprising a respective region of said ionizable gas, and a plurality of keep-alive means activatable for creating preconditioning flux within said body of ionizable gas to facilitate discharges at said cells, said method comprising the steps of, activating said keep-alive means, and applying addressing signals to selected ones of said cells at respective selected intervals subsequent to said activating of said keep-alive means, said applying step including the step of selecting the duration of said intervals in accordance with the respective positions of said selected cells and said keep-alive means.

* * * * *